US005287563A

United States Patent [19]

Peters

[11] Patent Number: 5,287,563

[45] Date of Patent: Feb. 22, 1994

[54] HYGIENIC URINAL

[76] Inventor: Scott W. Peters, 7730 Candle Green, Houston, Tex. 77071

[21] Appl. No.: 884,011

[22] Filed: May 18, 1992

[51] Int. Cl.[5] ..... E03D 13/00

[52] U.S. Cl. ..... 4/310; D23/302

[58] Field of Search ..... 4/301, 300.3, 310, 311; D23/302

[56] References Cited

U.S. PATENT DOCUMENTS

| | | | |
|---|---|---|---|
| 1,114,670 | 10/1914 | Baker | 4/310 |
| 1,379,206 | 5/1921 | Ohara | 4/310 X |
| 5,027,448 | 7/1991 | Wilkins | D23/302 X |

FOREIGN PATENT DOCUMENTS

| | | | |
|---|---|---|---|
| 0184472 | 5/1906 | Fed. Rep. of Germany | 4/310 |
| 0241370 | 3/1946 | Switzerland | 4/310 |
| 0020694 | of 1894 | United Kingdom | 4/311 |

*Primary Examiner*—Charles E. Phillips
*Attorney, Agent, or Firm*—Kenneth A. Keeling

[57] ABSTRACT

A hygienic urinal for installation in restrooms is disclosed. The hygienic urinal consists of an outer body and an inner body. The outer body comprises a pair of sidewalls connected at the rear edges to a rear wall, and a horizontally oriented top connected to both sidewalls and the rear wall resulting in a boxlike structure open at the front. The rear wall of the outer body is adjacent to and flush with a vertical wall of the restroom. The urinal bottom is recessed in the restroom floor and gradually sloped toward a centrally positioned drain. The inner body of the urinal consists of two inner sidewalls connected along their front edge to the outer body sidewalls and along their rear edge to an inner rear wall parallel to the outer rear wall. A urine deflector centered in the inner rear wall extending downward from the top of the urinal deflects urine toward the splatter shields to prevent urine from splashing onto the trousers or shoes of an individual using the urinal or surfaces of the surrounding restroom. Splatter shields are positioned on either side of the urine deflector extending from the inner rear wall angularly toward the front and parallel to a sidewall of the urine deflector. The urinal is connected at its upper end to a supply of water and is provided with internal passages to allow rinsing of urine from the urinal after by the operation of a flow control valve.

2 Claims, 1 Drawing Sheet

HYGIENIC URINAL

BACKGROUND OF THE INVENTION

1. FIELD OF THE INVENTION

This invention relates to restroom urinal receptacle apparatus of the type used from a standing position and particularly to features which serve to prevent the occurrence of unsanitary and undesirable splashback or splatter of urine.

2. BRIEF DESCRIPTION OF THE PRIOR ART

Conventional urinal receptacles are attached to the wall of the restroom or mounted on the floor of the restroom adjacent to a vertical wall. A disadvantage of the these designs is the occurrence of splashback or urine splatter onto the individual's clothing or shoes. These conventional urinal receptacles are designed with little regard to the angles of deflection which will occur when a stream of urine strikes any of the internal surfaces or the ultimate destination and resting place for any such urine which has struck an interior surface and been deflected or splattered.

The hygienic urinal of the present invention provides an integrally mounted deflector and splatter shields which directs urine away from the individual using the urinal and restroom surroundings preventing any splatter or secondary deflection of urine from the user.

As in conventional urinal receptacles, the hygienic urinal of the present design provides for a supply of water to be introduced into the interior of the urinal receptacle to rinse the urine from the interior surfaces and carry it into the sewer system in order to achieve a more sanitary and hygienic environment.

Baker U.S. Pat. No. 1,114,670 teaches the use of a symmetrically formed v-shaped backwall construction for urinal receptacles to attempt to decrease urine splattering and to confine urine to a flushed area.

Wilkens U.S. Pat. No. 5,027,448 teaches the use of an asymmetrically formed receptor cavity which is laterally offset to eliminate urine splattering.

SUMMARY OF THE INVENTION

It is an object of the present invention to provide a hygienic urinal which may be installed in existing restrooms utilizing standing type urinals.

It is a further purpose of the present invention to provide a hygienic urinal which may be installed in restrooms of new construction.

It is a further purpose of the present invention to provide a hygienic urinal wherein a urine deflector centrally positioned within the receptor cavity functions to deflect urine away from the individual utilizing the urinal and restroom surroundings It is a further purpose of the present invention to provide a hygienic urinal wherein a urine deflector centrally positioned within the receptor cavity and deflector shields positioned to each side of the deflector function together to deflect urine away from the individual utilizing the urinal and prevent any splatter from being deflected onto such individual or restroom surroundings.

These and other objects of the invention may be accomplished by a hygienic urinal consisting of an outer body and an inner body. The outer body comprises of a pair of sidewalls vertically oriented connected at the rear edges to a rear wall, and a horizontally oriented top connected to both sidewalls and the rear wall resulting in a boxlike structure which is open at the front. The rear wall of the outer body is mounted adjacent to and flush with a vertical wall of the restroom. The bottom of the urinal is recessed in the restroom floor and is gradually sloped toward a centrally positioned drain. The inner body of the urinal consists of two inner sidewalls which are connected along their front edge to the outer body sidewalls and along their rear edge to an inner rear wall which is generally parallel to the outer rear wall, a urine deflector centered in the inner rear wall and extending partially from the top of the urinal towards the bottom of the urinal, and splatter shields positioned on either side of the urine deflector.

The deflector consists of two planar surfaces attached along their rear edge to the rear inner wall of the urinal and extending at an angle from the rear inner wall of the urinal. The front edges of the deflector are joined at approximately a ninety degree angle in the center of the urinal. The deflector surfaces extend downward from the top of the urinal toward the floor of the urinal.

The two splatter shields are generally rectangular members which also partially extend downward from the top of the urinal towards the bottom of the urinal. The splatter shields are of uniform thickness and are angularly attached along their rear edge, one on each side of the deflector, to the rear inner wall of the urinal such that the surfaces of the splatter shield on each side of the deflector is generally parallel to the deflector surface positioned on that side of the urinal.

The deflector and splatter shields serves to prevent urine from splashing onto the trousers or shoes of an individual using the urinal or the surrounding restroom. The urinal is also connected to a supply of water which is allowed to flow into the urinal to rinse urine from the urinal after each use by the operation of a flow control valve and internal passages.

The foregoing and still other objects of this invention will become fully apparent, along with various advantages and features of novelty residing in the present embodiment, from study of the following description wherein indicia of reference are shown to match related points in the text, as well as the claims annexed thereto; and accordingly, a better understanding of the invention and the resulting improved performance is intended, by reference to the drawings, which are considered as primarily exemplary, and not to be construed as restrictive in nature.

DESCRIPTION OF THE PREFERRED EMBODIMENT

Figure 1:
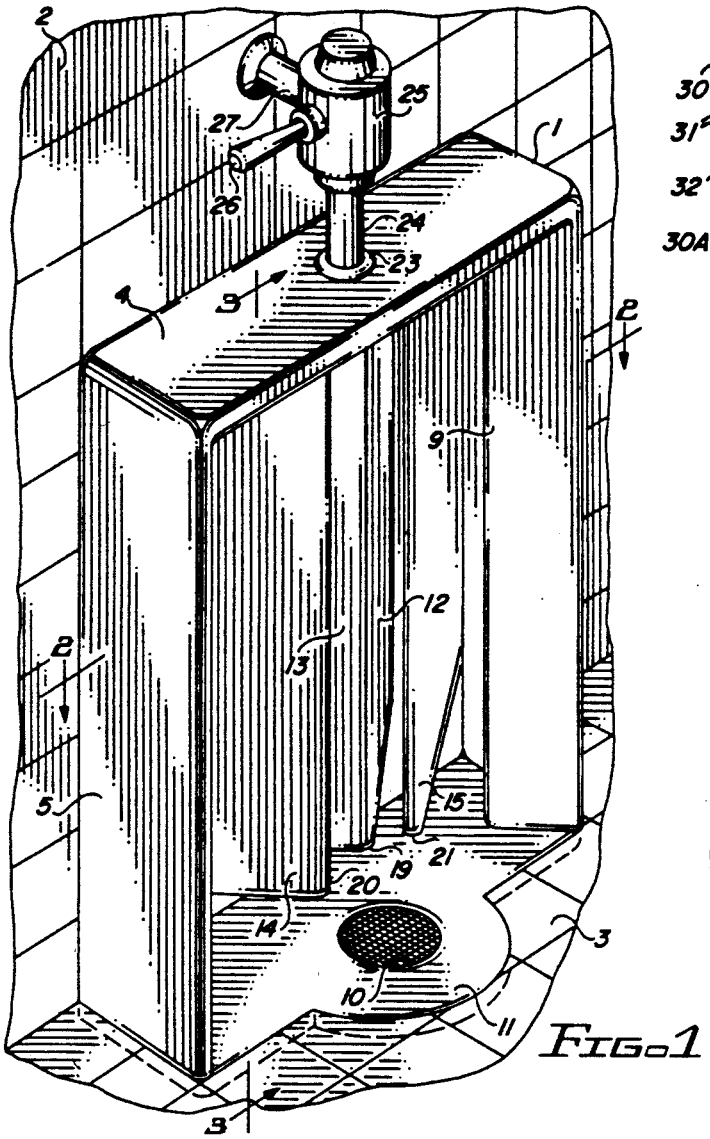
FIG. 1 illustrates an isometric view of the hygienic urinal of the present invention.

Referring first to FIG. 1, the hygienic urinal of the present invention is shown in isometric as installed within a restroom. The hygienic urinal 1 is installed adjacent to a vertical wall 2 of the restroom and recessed into the floor 3 of the restroom. Externally, the urinal 1 is defined by a rectangular rear wall 6 (See FIGS. 2 and 3) which is adjacent to and flush with restroom wall 2, a generally rectangular top wall 4 connected to the top edge of the rear wall 6 and extending horizontally outward from rear wall 6, generally rectangular left outside wall 5 and generally rectangular right outside wall 7 both of which extend vertically from restroom floor 3 to the top surface 4 and connected to rear wall 6 perpendicularly along each side edge of rear wall 6. The floor of the urinal 11 is recessed within restroom floor 3 and is gradually sloped towards a centrally located drain 10. Rear wall 6, top surface 4, left outside wall 5, right outside wall 7 and floor 11 define a box-like structure open at the side opposite rear wall 6, which open side will sometimes be referred to herein as the front.

Figure 2:
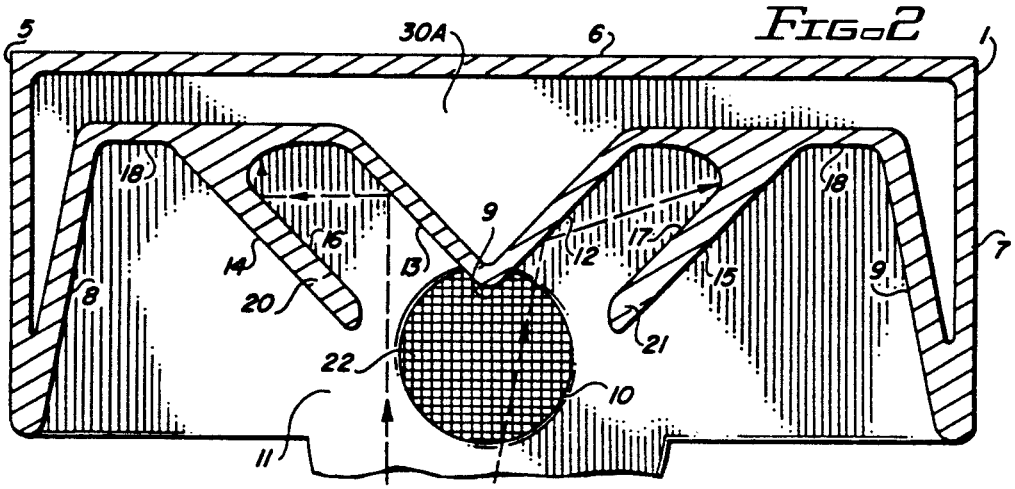
FIG. 2 illustrates a cut-away top profile view of the hygienic urinal of the present invention

Referring to FIG. 2, the interior elements of the urinal 1 include a left interior side wall 8 which is joined to the left exterior side wall 5 along its front edge forming an acute angle between them. Likewise, the right interior wall 9 is joined to the right exterior side wall 7 along its front edge forming an acute angle between them. Interior rear wall 18 is parallel to exterior rear wall 6 and is joined along its left side to interior side wall 8 and at its right side to interior side wall 9.

Interior upper surface 28 is located below and parallel to top surface 4. Interior upper surface 28 adjoins interior rear wall 18 and each of interior side walls 8 and 9.

Rear wall 6, top surface 4, and outside side walls 5 and 7, on the one hand, and rear interior rear wall 18, interior upper surface 28, and interior side walls 8 and 9, on the other define upper interior cavity 30 and lower interior cavity 30A. Interior cavity 30 is separated from interior cavity 30A by partition 32 connecting rear wall 6 and interior rear wall 18.

A deflector 19 protrudes frontally from the interior rear wall 18. The deflector 19 consists of a left generally rectangular deflector surface 13 and a right generally rectangular deflector surface 12 which extend downward from the interior upper surface 28 of the urinal 1 toward urinal floor 11. Surface 12 and surface 13 of deflector 19 are connected along common frontal edges. Surface 12 and surface 13 are connected at approximately a 90° degree angle. Surface 12 and surface 13 each intersect interior rear wall 18 of the urinal 1 at angles of approximately 45° degrees. The deflector 19 is equally distant from interior side wall 8 and interior side wall 9.

A generally rectangular left splatter shield 20 extends from the rear interior wall 18 of the urinal extending from top side 4 toward urinal floor 11. Left splatter shield 20 is attached to the rear interior wall 18 between the intersection of the rear interior wall 18 with the left deflector surface 13 and the rear interior wall 18 with the left interior wall 8. Left splatter shield 20 is constructed of generally uniform thickness and extends toward the front of the urinal 1 in a plane which is generally parallel to the left deflector wall 13. The angle of intersection of the left splatter shield 20 and the rear interior wall 18 is therefore also approximately forty-five degrees. In similar manner, the right splatter shield 21 is positioned and attached to the rear interior wall between the right deflector surface 12 and the right interior wall 9 so that the front surface of the right splatter shield 15 is generally parallel to the right deflector surface 12.

Referring again to FIG. 1, the urinal floor 11 possesses a semi-circular extension which is located in front of the drain 10. Drain 10 is covered with a removable mesh covering 22 so as to allow only liquid to pass into drain 10.

Urinal top surface 4 contains an aperture 23 through which a pipe 24 extends into the interior of the urinal 1. Tubular conduit 24 is connected to the discharge outlet of manually operated flow control valve 25. The inlet (not shown) of the manually operated flow control valve 25 is operatively connected to a source of water by pipe 27 which extends into the restroom wall 2 adjacent to which the hygienic urinal is installed.

Figure 3:
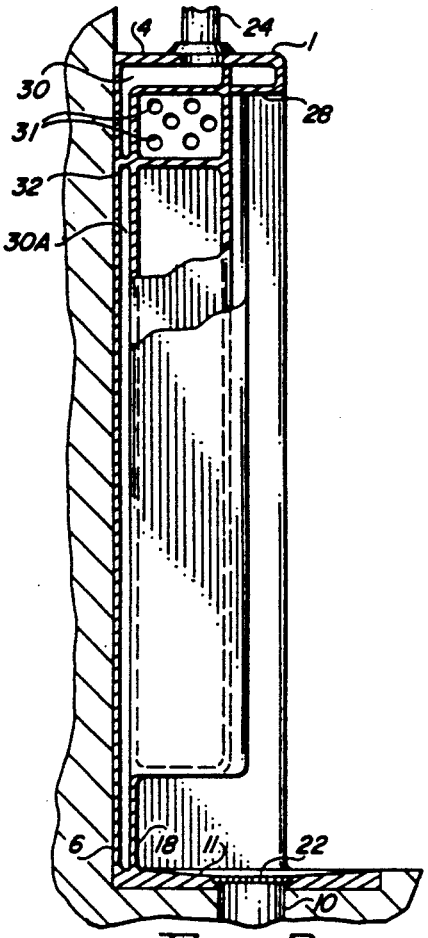
FIG. 3 illustrates a side cross section view of the hygienic urinal of the present invention.

Referring to FIG. 3, aperture 23 provides operational connection of conduit 24 with interior cavity 30. Various apertures 31 are provided in left deflector surface 12 and right deflector surface 13 above partition 32, which apertures 31 provide operational connection with interior cavity 30, whereby, upon opening of valve 25, water flows through conduit 27, interior cavity 30 and apertures 31.

OPERATION

Referring to FIG. 3, an individual utilizing the hygienic urinal of the present invention 1 would direct urine toward the deflector 19 via numerous vectors. By way of illustration, vectors a. and b. are shown in FIG. 2. Due to the positioning of the deflector surfaces 12 and 13, the stream of urine would be deflected by deflector surfaces 12 and 13 such that it would initially strike the rear surface 16 of left splatter shield 20 and rear surface 17 of right splatter shield 21. Due to the geometry of the deflector 19 and the location of the deflector surfaces 20 and 21 relative to deflector 19, urine striking the deflector surfaces 12 and 13 will be deflected away from the user and surrounding restroom.

A supply of fresh water is provided to the urinal 1 through the pipe 27 which is connected to the inlet (not shown) of flow control valve 25. Operation of the control handle 26 of valve 25 allows a predetermined volume of water to flow through the valve 25 into tubular conduit 24. The water then flows through the tubular conduit 24 and aperture 23 into interior cavity 30. The water is then dispersed to the interior of the urinal through the apertures 31 connecting the interior cavity 30 to the deflector surfaces 12 and 13 onto the deflector surfaces 12 and 13 and the rear surfaces 16 and 17 of the splatter shields 20 and 21 thereby rinsing the urine from surfaces 12, 13, 16, and 17 and carrying it along to the floor of the urinal 11. The water and urine then flow to the centrally located drain 10, through the mesh drain cover 22 and into the sewer system.

Although this invention has been described fully with special emphasis upon a preferred embodiment, it should be understood that within the scope of the appended claims the invention may be practiced otherwise than as specifically described herein.

I claim:

1. A standing-type hygienic urinal comprising an outer body consisting of a vertical rear wall and two vertical side walls each of which is connected along its rear edge to a side edge of the vertical rear wall, a top surface and a floor surface;

a receptor cavity consisting of a vertical rear inner wall, a generally horizontal upper surface and two vertical inner side walls each of which is connected along its front edge to the front edges of a side wall of the outer body;

a deflector consisting of at least two joined deflector surfaces, each of said deflector surfaces extending downwardly from the top of the urinal;

shield means consisting of at least two shield members, each of said shield members extending angularly outward from the receptor cavity;

flushing means consisting of a water supply conduit, a water control valve operatively connected to the said water supply conduit, a discharge conduit for discharging water from the water control valve to the receptor cavity;

drain means consisting of an aperture provided in the floor of said urinal operatively connected to a sewer discharge conduit;

each of said at least two shield members extending angularly from the inner rear wall such that it is positioned approximately parallel and adjacent to a deflector surface; and each of said at least two shield members extending angularly from the inner rear wall a distance greater than said deflector surfaces extend from the inner rear wall.

2. A standing-type hygienic urinal comprising an outer body consisting of a vertical rear wall and two vertical side walls each of which is connected along its rear edge to a side edge of the vertical rear wall, a top surface and a floor surface;

a receptor cavity consisting of a vertical rear inner wall, a generally horizontal upper surface and two vertical inner side walls each of which is connected along its front edge to the front edges of an adjacent side wall of the outer body;

deflector means consisting of a plurality of deflector surfaces extending downward from the top of the urinal and angularly connected to each other along one vertical edge, each deflector surface being angularly connected to the rear wall of the receptor cavity;

shield means consisting of at least two shield members, each member being connected along one edge to the rear wall of the receptor cavity and extending angularly outwardly therefrom adjacent one of the deflector surfaces, each of said shield members being parallel to and spaced from a corresponding deflector surface;

flushing means consisting of a water supply conduit, a water control valve operatively connected to the said water supply conduit, and a discharge conduit for discharging water from the water control valve to the receptor cavity, said discharge conduit including operatively connected passages integrally located within said receptor cavity and said deflector means whereby water may be conducted to the surfaces of the receptor cavity for rinsing the receptor cavity surfaces;

drain means consisting of an aperture positioned within the floor surface of the said urinal and conduit means connected to the said aperture to conduct liquid from the urinal to the sewer system; and said shield members angularly extending from the inner rear wall a distance greater than the corresponding deflector surfaces extend from the inner rear wall.

* * * * *